United States Patent [19]

Klein et al.

[11] Patent Number: 4,488,010

[45] Date of Patent: Dec. 11, 1984

[54] LOUDSPEAKER

[76] Inventors: Siegfried Klein, r.Tour dÁûrgne, Paris, France; Rainer J. Haas, Unterbuschweg, Cologne, Fed. Rep. of Germany

[21] Appl. No.: 422,154

[22] Filed: Sep. 23, 1982

[30] Foreign Application Priority Data

Sep. 28, 1981 [DE] Fed. Rep. of Germany ..... 3138566

[51] Int. Cl.[3] ..... H04R 7/12

[52] U.S. Cl. ..... 179/110 A; 310/371

[58] Field of Search ..... 179/110 A, 110 B, 110 F, 179/110 R, 181 R; 310/371

[56] References Cited

U.S. PATENT DOCUMENTS 3,100,291 8/1963 Abbott ..... 310/369

3,393,764 7/1968 Schafer ..... 181/146

FOREIGN PATENT DOCUMENTS 63094 3/1982 European Pat. Off. ..... 179/110 A

*Primary Examiner*—Stafford D. Schreyer

*Assistant Examiner*—L. C. Schroeder

*Attorney, Agent, or Firm*—Steele, Gould & Fried

[57] ABSTRACT

A loudspeaker primarily for the high frequency audio region includes a driving device coupled to a diaphragm of convex outer configuration and extending over more than 180° spherical angle. The driving device changes the distance between the two coupling areas of the diaphragm under the action of an electrical signal applied thereto. Elastic deformations appear on the diaphragm which give rise to an emission of sound-waves.

14 Claims, 10 Drawing Figures

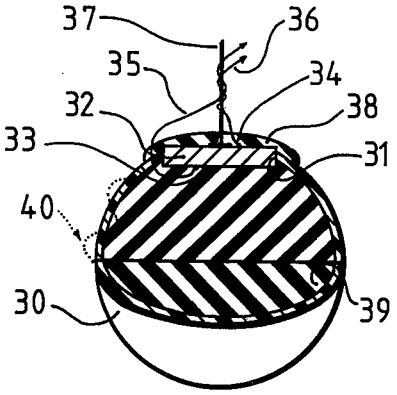
FIG. 1
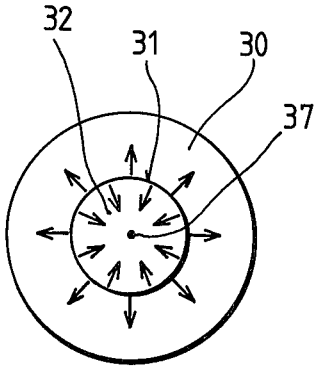
FIG. 2
FIG. 3
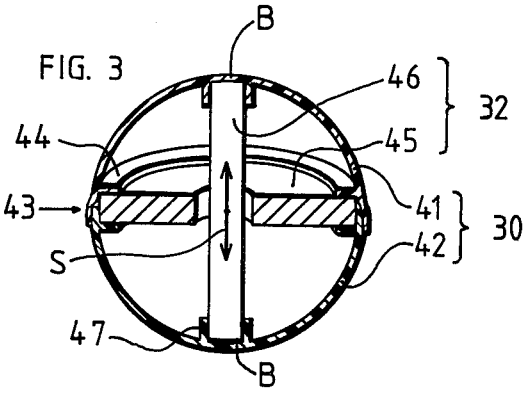

LOUDSPEAKER

BACKGROUND OF THE INVENTION

1. FIELD OF THE INVENTION

The present invention relates to a loudspeaker and more particularly to a loudspeaker for reproducing the highfrequency range of the audible spectrum, commonly referred to as a tweeter. The loudspeaker has a thin and relatively stiff diaphragm fixed to a driving device which forces the diaphragm to vibrate.

2. THE PRIOR ART

In the conventional types of loudspeakers for highfrequencies the diaphragm is in the form of a hollow dome of convex outer configuration and extends over almost 180° spherical angle. These diaphragms of dome-shape do not focus the soundwaves emitted as do diaphragms in the form of hollow cones often used for lower sound frequencies and as those having forwardly diverging surfaces do.

In the tweeter-loudspeaker according to U.S. Pat. No. 3,059,720 the diaphragm is dome-shaped and has an annular rim or flange attached, surrounding the diaphragm. The annular flange is made of a soft material which allows the dome-shaped diaphragm to vibrate and fixes the diaphragm to a housing of the loudspeaker and centers the diaphragm at the same time. The diaphragm is rigidly fixed to a voice coil concentric therewith. The voice coil is inside an air gap of a magnetic system, the air gap surrounding the voice coil. The voice coil and the magnetic system form the driving device of the known loudspeaker. When driven by this electrodynamic driving device the diaphragm moves back and forth, whereby the annular flange is deformed. It is intended in the known type of loudspeaker, that the diaphragm moves without changing its form, i.e. oscillates as a perfectly stiff body. Nevertheless vibrations between different areas of the diaphragm cannot be avoided in practice without making the diaphragm so heavy, that its inert mass becomes too high so that the very quick motions required for high-frequency sound reproduction cannot be obtained with reasonable driving forces. Partial vibrations of areas of the diaphragm produce soundwaves not contained in the electric signal to be converted. Further the sound emission of the soft annular flange cannot be totally damped and is audible as parasitic vibrations. The annular flange, which serves to center and hold the diaphragm should be as soft as possible in order not to influence the motion of the diaphragm over the whole frequency range of the loudspeaker. In practice this aim cannot be reached at present, so that the flange thus influences the frequency response of the loudspeaker.

Tweeters should emit soundwaves in as many directions of sperical angle as possible. The angle of sound emission of the known loudspeakers having dome-shape diaphragms are smaller than 180° of spherical angle. Thus a listener is always able to locate the position of the loudspeaker as the sound emission is not omnidirectional.

SUMMARY OF THE INVENTION

It is an object of the present invention to provide a loudspeaker especially suited for high-frequencies of the audible range having an isotropic emission of soundwaves, i.e. radiating soundwaves omnidirectionally.

A further object of the invention is the provision of a loudspeaker having no annular flange influencing the motion of the diaphragm and emitting soundwaves itself.

Yet another object of the invention is the provision of a loudspeaker which does not radiate soundwaves from the back side of the diaphragm, so that acoustical short-circuits of these emissions with the normal and intended emissions from the front side of the diaphragm are avoided.

A still further object of the invention is the provision of a loudspeaker being easy to assemble, i.e. avoiding the need of centering the diaphragm and its part of the driving device.

A still further object of the invention is the provision of a loudspeaker having no housing which may obstruct the sound emission in at least one direction.

According to the present invention the diaphragm is positively deformed elastically by the driving device, so that elastic deformations appear on the diaphragm. Thus, contrary to the known loudspeakers where a diaphragm is intended to be as stiff as possible and sound emission occurs by moving the diaphragm back and forth in one direction, the loudspeaker diaphragm of this invention is deformed elastically without moving as a whole. The elastic deformations appear on every partial area of the almost totally spherical diaphragm and give rise to sound emissions in all directions with equal amplitude.

There is no housing unit obstructing the sound emission, as the driving unit is preferably inside the sphere formed by the diaphragm. Further, there is no need for a housing, and the diaphragm does not need a counter mass because it does not move in its entirety. In the loudspeaker according to this invention there is no need for an annular flange fixing the diaphragm to a housing. These parts are eliminated and cannot influence the sound emission of the diaphragm.

In the inventive loudspeaker there is no need for centering the diaphragm and keeping it in its centered position. The sound emission is almost and nearly perfectly isotropic, so that a listener cannot locate the loudspeaker when listening. The sound emitted from the loudspeaker is likely to seem to come from any direction.

Finally the problem of sound emission of the back side of the diaphragm is avoided. The diaphragm is preferably a total or nearly total sphere. Thus, the soundwaves emitted from the inner walls of this sphere cannot reach the outside and cannot influence of interfere with the soundwaves emitted from the outer surface of the ball-like diaphragm. The soundwaves emitted from the inner surfaces can be absorbed by a soft, sound absorbent material inside the diaphragm such as sponge rubber. Absorbing the soundwaves originating from the inner surfaces avoids a mechanical coupling of these sound excitations with the diaphragm and to the outer surface. If the diaphragm forms a total sphere it is recommended that a very small opening be left for equalizing atmospheric presure.

The loudspeaker of the invention is thus very close to the ideal of an omnidirectional, non-focusing loudspeaker. Whereas the sound emission of the known loudspeaker originates from moving a stiff body just like a piston, the diaphragm of the inventive loudspeaker is elastically deformed and shows elastic waves just like waves in a pond after locally disturbing the surface of the water.

Driving devices in the form of electrodynamic transducers may be employed, although driving devices made of piezoelectric or electrostrictive or magnetostrictive material are preferred. The driving force of the driving device as well as the amplitude of the driving forces should be well adapted to the mechanical properties of the diaphragm. A very durable mechanical link between the driving device and the diaphragm is needed.

In a preferred embodiment the driving device is in the form of a disk, able to vibrate radially made of piezoelectric material. In combination with the preferred, fully spherical diaphragm these disk-like driving devices produce circular states of vibrations and only very small mechanical intermodulations. Circular states of vibration of the diaphragm may also be obtained by using a bar-like driving device diametrally fixed in the diaphragm. Combinations of ring-like and bar-like driving units gave very good results.

Although the diaphragm principally may have any convex shape, hollow bodies of closed configurations, and especially spheres, are preferred, as their sound emission is more isotropic than other embodiments of the diaphragm. The diaphragm may have oval form or the form of a paraboloid. In a hollow body of closed configuration the problem of sound emission of the inner surfaces is less.

In the preferred embodiment of the invention the loudspeaker has a hollow-spherical diaphragm having a circular opening for attaching a disk-like driving device. In this embodiment the symetrical conditions between the shapes of the diaphragm, driving unit and the vibrational excitations on the diaphragm are very good. The disk-like driving device can be made arcuate and thus follow the spherical curvature of the diaphragm and complete the sphere. As rather high mechanical forces have to be transferred from the driving device to the diaphragm the mechanical coupling between these two parts is of high importance. In the preferred embodiment the driving unit exactly fits into an opening or an inside dimension of the spherical diaphragm, so that the driving unit directly moves and exites the diaphragm when increasing its dimensions. In order to transfer pulling forces, as well, a form link between the diaphragm and the driving device is preferred. In a preferred embodiment the diaphragm has a circular opening exactly adapted to the diameter of the disk-like driving unit, said opening having a collar protruding towards the center of the opening. The collar has projections fitting into axial bores of the driving device. Alternatively, the driving device has projections, which fit into holes of the diaphragm. Thus pushing as well as pulling forces can be coupled from the driving device to the diaphragm.

The preferred location of the driving device is inside the diaphragm, though it may be outside the diaphragm exciting it at its outer surface. The latter embodiment allows use of a complete sphere for the diaphragm. A combination of the driving device inside the diaphragm acting on its inner surface and a further driving device outside the diaphragm acting on its outer surface allows for an easy coupling of pushing and pulling forces to the diaphragm.

Hanging the loudspeaker from a stand or otherwise mounting it is easy, as any driving device has a nodal point of vibration, which is normally the center of mass of this driving device. A small pin or a thread is fixed to that center for suspending or holding up the driving unit and thus the loudspeaker. These means for holding the loudspeaker do not influence the mechanical vibrations or the emission of soundwaves.

Focussing points of the mechanical deformations on the diaphragm should be carefully considered and avoided if possible. In loudspeakers having the preferred almost spherical diaphragm and a disk-like driving device in a polar region the vibrations emitted from this driving device accumulate in the other polar region of the spherical diaphragm. In order to avoid reflections and intermodulations of the soundwaves an opening is made in the diaphragm at such focussing points. The opening is filled with a sound-absorbent material. Alternatively a further driving device is fixed to said second opening and vibrates in phase with the vibrations arriving at the edge of said second opening. Reflections are avoided, the vibrations being absorbed in or by the absorbent material or by the second driving unit.

Further aspects of the present invention can be appreciated by reference to the drawings and the accompanying discussion.

BRIEF DESCRIPTION OF THE DRAWINGS

In the drawings,

FIG. 1 shows a perspective representation of a loudspeaker having a spherical diaphragm and a disk-like driving unit, a quarter-sphere being cut away to show the inner configuration, FIG. 2 shows a top view of a loudspeaker as shown in FIG. 1, FIG. 3 shows a cross-sectional view of a loudspeaker having a ring-like driving device in its equatorial region and a bar-like driving device between its polar regions, the diaphragm being a full sphere, FIG. 4 shows a cross sectional view of a loudspeaker having a normal vibration producing driving device at the top and a further driving device for absorbing at the bottom, FIG. 5 shows a cross sectional view of a loudspeaker having a plurality of disk-like driving units arranged on the equator and on small circles of the sphere.

DETAILED DESCRIPTION OF THE PREFERRED EMBODIMENTS

Figure 6:
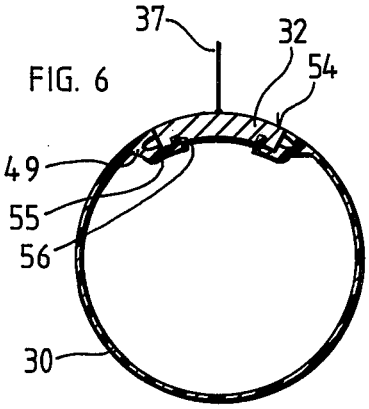
FIG. 6 shows a sectional view of a spherical loudspeaker having a driving unit of arcuate shape.

The loudspeaker shown in FIGS. 1 and 2 has a diaphragm 30 which is made by cutting a circular opening 31 into a ping-pong ball. A driving unit 32 in the form of a cylindrical disk is exactly fitted into this opening 31 and rigidly fixed to the edges of this opening 31. The driving unit 32 is covered by electrodes 33, 34 on its cylindrical surfaces, these electrodes 33, 34 are electrically connected with leads 35, 36, respectively.

The disk-like driving device is fixed to a thread 37 in its geometrical center, this thread 37 also supporting the flexible leads 35, 36.

A flat layer 38 of soft-foam material covers the outer side of the driving device 32, so that the direct radiation of soundwaves from the driving device 32 is damped and adapted to other portions of the diaphragm 30. In its interior the diaphragm 30 is completely filled by a soft sound-absorbent material 39 e.g. sponge rubber.

If an electrical signal is applied to the two leads 35, 36, the disk-like driving device 32 changes its geometrical dimensions. Its diameter becomes greater and smaller. Thus the diameter of the opening 31 becomes greater and smaller and states of vibration 40 as shown in FIG. 1 (amplitude exaggerated) by pointed lines appear on the diaphragm 30. These vibrations 40 excite the air surrounding the diaphragm 30 and give rise to emission of sound radiation.

The driving forces between the driving device 32 and the diaphragm 30 for pushing and pulling forces are shown in FIG. 2 by means of arrows.

In the embodiment according to FIG. 3 the diaphragm 30 is built up out of two hemispherical cups 41, 42, which are rigidly connected in their equatorial region 43. A ring-like flange 44 protrudes close to the equatorial regions 43 towards the inside. These two flanges 44 clamp a transducer 45 in form of a ring-like disk, able to vibrate radially. This cylindrical transducer 45 exactly fits with its outer cylindrical surface engaging the inner surface of the spherical diaphragm 30. Thus rather large areas for coupling the transducer 45 to the diaphragm 30 are formed and a permanent link between the two parts 30, 45 is reached.

In addition to the transducer 45 the driving device 32 of the loudspeaker according to FIG. 3 has a bar-like transducer 46 which penetrates the opening of the ring-like transducer 45 without contacting the latter. This bar-like transducer 46 extends radially i.e. between the two polar regions of the diaphragm 30. Its normal length equals the inner diameter of the diaphragm 30. The transducer 46 is fixed in ring-like sockets 47 of each cup 41, 42, thus forming rather large areas of contact.

For a loudspeaker according to FIGS. 1 and 2 it is quite obvious that the volume of the spherical diaphragm 30 remains generally constant during normal vibrations. The loudspeaker according to FIG. 3, can also be constructed and excited in such a way that the total volume generally remains constant. This is possible by electrically driving the two transducers 45, 46, in such a way, that the bar-like transducer 46 always moves in the same direction as its socket 47 would do in the absence of said transducer 46.

Alternatively the two transducers 45, 46 of the loudspeaker according to FIG. 3 may be driven in phase, thus the vibrations of this loudspeaker are more like a pulsating sphere.

The basic principles of operation of the inventive loudspeaker may be examplified by means of the bar-like transducer 46.

This transducer 46 exhibits mechanical variations in length under the action of an electrical signal, in the direction S. The transducer 46 thus changes its length between its two opposite end portions. The transducer 46 is fixed between two coupling areas B of the diaphragm 30, which are spaced apart in the direction of vibration S. The two coupling areas B are moved relative to each other by variations in the length of transducer 46 and thus the diaphragm 30 is forced to vibrate.

A loudspeaker according to FIG. 4 is similar to the one shown in FIG. 1, with the exception that a form link exists between the driving device 32 and the diaphragm 30. However, this embodiment is provided with an additional sound absorbing driving unit 48.

The top opening 31 of the diaphragm 30 is limited by a collar 49, the diameter of which equals the diameter of the disk-like driving device 32. The height of this collar 49 is the same as the thickness of the driving device 32. An L-shaped protrusion 50 is fixed to the collar 49 and engages into a ring-like groove 51 of the driving device 32. Thus, pulling forces are transferred to the diaphragm 30.

A second driving unit 48 is fixed to the diaphragm 30 exactly opposite to the first driving device 32. This driving unit 48 is electrically driven in such a way that it follows the motions of the edges of its opening 52. The vibrations originating from the first driving device 32 cannot be reflected, and thus, the edges of the opening 52 cannot produce intermodulations with vibrations produced later on.

The second driving unit 48 thus absorbs the mechanical excitations produced by the first driving device 32. The second driving unit 48 is located in the area of accumulation of the states of vibration produced by the first driving device 32, i.e. opposite to this first driving device 32.

It is also possible to feed the two driving devices 32, 48 in phase.

In the embodiment according to FIG. 5 the diaphragm is also built up of two semi-spherical cups 41, 42. A plurality of disk-like transducers 53 are fixed to the inner surfaces of the sphere created by the two cups 41, 42 and form the driving device 32. The disk-like transducers 53 are parallel to each other leaving a small free space between them. They are glued at their outer ring-like surfaces to the inner surfaces of the diaphragm 30. In this embodiment an excitation of the diaphragm 30 in form of spherical vibrations is also possible.

Figure 7:
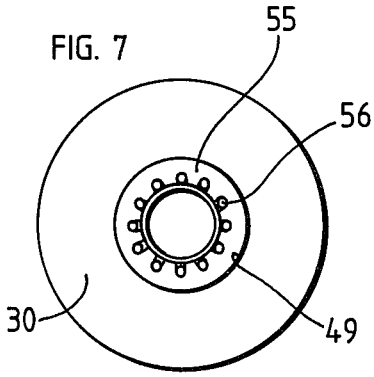
FIG. 7 is a top view on a diaphragm (without driving unit) of a loudspeaker according to FIG. 6.

In the embodiment according to FIGS. 6 and 7 the disk-like driving device 32 is arcuate, having a spherical outer surface. The radius of curvature equals the radius of the spherical diaphragm 30, so that the driving unit 32 and the diaphragm 30 form a full sphere. This loudspeaker has a form link between the diaphragm 30 and the driving device 32. A collar 49 defining the opening 31 is formed integrally with the diaphragm 30. A small flange 55 protrudes towards the center of the opening 31 and carries pins 56 projecting outwards. These pins 56 fit into corresponding holes of the driving device 32, so that a form link is obtained.

Figure 8:
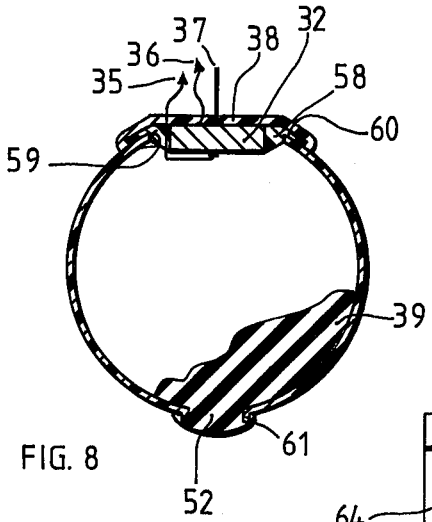
FIG. 8 shows a cross-sectional view of a loudspeaker having an opening filled by sound-absorbent material.

In the embodiment according to FIG. 8 the loudspeaker illustrates a sound absorbing, anti-polar opening 52 and a different way of fixing the disk-like driving device 32 to the diaphragm 30.

The disk-like driving device 32 is surrounded by and fixed to a separate clamping collar 58. The assembly of driving device 32 and collar 58 is then put into an opening 59 of the spherical diaphragm 30 and glued thereto. The collar 58 has a rim 60 protruding outwards, thus creating rather large areas for fixing the collar 58 to the diaphragm 30. Collar 58 allows for an easy way of fixing the inner lead 35, thus easing the assembly of the loudspeaker. The driving device 32 and the collar 58 are overlaid with a sound absorbing layer 38.

A smaller opening 52 is provided in the diaphragm 30, anti-polar to the opening 58. This opening 52 is bridged by the material 59 filling the interior of the diaphragm 30. In order to obtain a durable connection between the soft material 39 and the edges of the opening 52 a ring protruding outwards is provided at the diaphragm 30 defining the opening 52. The states of vibrations originating from the driving device 32 and of generally circular shape are absorbed in the area of the opening 52 by the soft material 39. Thus they are not reflected at the edges of the opening 52 and cannot accumulate in a focussing point.

Figure 9:
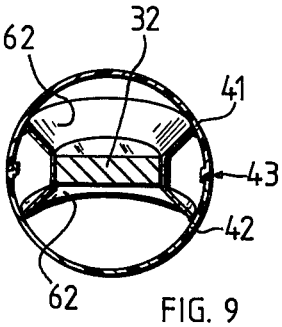
FIG. 9 shows a cross-sectional view of the loudspeaker having a disk-like driving device in its equatorial plane coupled to the diaphragm.

In the embodiment according to FIG. 9 the diaphragm is again built up of two semi-spherical cups 41, 42. In the equatorial plane i.e. the plane of connection, lies a disk-like driving device 32 having a smaller diameter than the inner diameter of the diaphragm 30. The driving device 32 is coupled by means of two thin, frusto-conical collars 62 to the inner wall of the diaphragm 30. As in the embodiment of FIG. 8 the main aim is to care for a very durable and solid interconnection between the separate part (collar 58 or 62) and the diaphragm 30, whereby this connection can be realised outside the small inner space of the diaphragm 30. In a later stage of assembly the separate parts 58 or 62 having large contacting areas are glued to the diaphragm 30.

Figure 10:
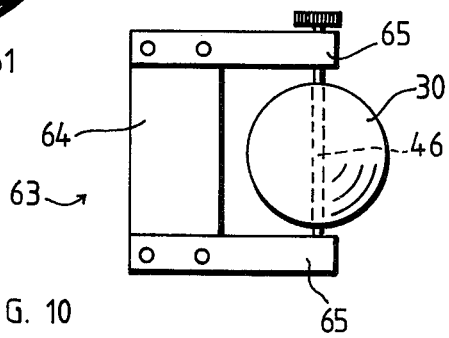
FIG. 10 is a side elevation of a loudspeaker, the driving device being outside of the diaphragm.

In the embodiment of FIG. 10 a driving device 63 is situated outside the diaphragm 30 being a ping-pong-ball. The driving device 63 is situated outside the diaphragm 30 being of U-shape has a vertical base 64 made of a rectangular, prismatic block of a piezoelectric material and two arms 65 fixed thereto for transfer of the motion of the block to the ping-pong-ball. In this embodiment forces compressing the diaphragm 30 are applied directly and without the need for coupling parts to the diaphragm 30. In addition, a bar-like transducer 46 can be arranged inside the diaphragm 30 as shown in FIG. 10 by dashed lines. This results in an ideal transfer of the exciting forces from the two transducers to the diaphragm 30.

Instead of punching an opening 52 serving to absorb the excitations of vibrations, it is possible to attach a layer similar to layer 38 onto the outside of the areas of accumulation of vibrations. This layer absorbs and damps the vibrations and avoids radiating accumulation areas reproducing sounds not contained in the electrical signal.

We claim:

1. A loudspeaker, comprising:

a driving device for converting an electrical input signal connected thereto into a mechanical motion and having at least two opposite end portions at a distance from one another which changes under the action of the electrical signal;

a diaphragm of convex outer configuration extending over nearly 360° spherical angle, the diaphragm being made of a thin and relatively stiff material, nevertheless being able to deform elastically when locally excited and being coupled in at least two coupling areas of the diaphragm to the opposite end portions of the driving device, respectively, said driving device being limited by the diaphragm, and said diaphragm having a small opening for equalizing atmospheric pressure; and means for supporting the loudspeaker, said means being fixed to the center of mass of the driving device, whereby, under the action of the electrical signal applied to the driving device, the distance between the at least two coupling areas of the diaphragm changes and elastic deformations appear on the diaphragm and give rise to emission of sound waves.

2. A loudspeaker as claimed in claim 1, wherein the diaphragm is of spherical shape and the driving device is limited by the sphere defined by said diaphragm.

3. A loudspeaker as claimed in claim 1, wherein the driving device has a disk-like shape and is able to vibrate radially under the action of the electrical signal applied thereto.

4. A loudspeaker as claimed in claim 1, wherein the driving device has the form of a bar able to vibrate longitudinally under the action of the electrical signal applied thereto.

5. A loudspeaker as claimed in claim 2, wherein the diaphragm forms an almost complete sphere and has a circular first opening, and further comprising means for coupling the driving device fixed over and bridging said opening of the diaphragm.

6. A loudspeaker as claimed in claim 5, wherein the almost completely spherical diaphragm has a second opening located diametrically opposite to the first opening, and further comprising a vibration absorbent material at least partly covering the second opening.

7. A loudspeaker as claimed in claim 1, wherein the diaphragm comprises two hollow hemispheres rigidly fixed to one another and forming a full sphere.

8. A loudspeaker as claimed in claim 1, further comprising a sound absorbent material at least partly filling the free space inside the diaphragm.

9. A loudspeaker as claimed in claim 1, having means for holding the loudspeaker on a stand, said means being fixed to the loudspeaker at a nodal point of vibration.

10. A loudspeaker as claimed in claim 3, wherein the driving device is made from one of piezoelectric material, magnetostrictive material and electrostrictive material.

11. A loudspeaker as claimed in claim 4, wherein the driving device is made from one of piezoelectric material, magnetostrictive material and electrostrictive material.

12. A loudspeaker according to claim 1, wherein the driving device is located within the diaphragm.

13. A loudspeaker as claimed in claim 2, wherein the driving device is located within the diaphragm.

14. A loudspeaker according to claim 8, wherein the sound absorbent material is foam rubber.

* * * * *

UNITED STATES PATENT AND TRADEMARK OFFICE

CERTIFICATE OF CORRECTION

PATENT NO. : 4,488,010

DATED : December 11, 1984

INVENTOR(S) : Klein et al

It is certified that error appears in the above-identified patent and that said Letters Patent is hereby corrected as shown below:

Column 1, line 55, "sperical" should read -- spherical --.

Column 2, line 49, "of" should read -- or --.

Column 7, line 35, "of" should read -- or --.

Signed and Sealed this

*Fourth* Day of *June 1985*

[SEAL]

*Attest:*

DONALD J. QUIGG

*Attesting Officer* *Acting Commissioner of Patents and Trademarks*